US011634987B2

(12) United States Patent
Luo et al.

(10) Patent No.: US 11,634,987 B2
(45) Date of Patent: Apr. 25, 2023

(54) SAFETY EARLY WARNING METHOD AND DEVICE FOR FULL-SECTION TUNNELING OF TUNNEL FEATURING DYNAMIC WATER AND WEAK SURROUNDING ROCK

(71) Applicant: Institute of Rock and Soil Mechanics, Chinese Academy of Sciences, Wuhan (CN)

(72) Inventors: Hongming Luo, Wuhan (CN); Jun Gao, Wuhan (CN); Shanxiong Chen, Wuhan (CN); Xiao Lin, Wuhan (CN); Lingfa Jiang, Wuhan (CN); Liyun Yang, Wuhan (CN); Min Chen, Wuhan (CN); Yu Tang, Wuhan (CN); Dean Liu, Wuhan (CN); Sheng Wang, Wuhan (CN); Xuejun Peng, Wuhan (CN); Wenguo Yang, Wuhan (CN); Xiaobo Xie, Wuhan (CN); Xingli Li, Wuhan (CN); Dexing Wu, Wuhan (CN); Xiaozhen Xiang, Wuhan (CN)

(73) Assignee: Institute of Rock and Soil Mechanics, Chinese Academy of Sciences, Wuhan (CN)

( * ) Notice: Subject to any disclaimer, the term of this patent is extended or adjusted under 35 U.S.C. 154(b) by 0 days.

(21) Appl. No.: 17/478,307

(22) Filed: Sep. 17, 2021

(65) Prior Publication Data

US 2022/0112806 A1 Apr. 14, 2022

(30) Foreign Application Priority Data

Oct. 13, 2020 (CN) ..... 202011088248.X

(51) Int. Cl.
*E21F 17/18* (2006.01)
*E21D 9/00* (2006.01)

(52) U.S. Cl.
CPC ..... *E21F 17/185* (2013.01); *E21D 9/003* (2013.01)

(58) Field of Classification Search
CPC ..... E21F 17/185; E21D 9/003
See application file for complete search history.

(56) References Cited

U.S. PATENT DOCUMENTS

2017/0284801 A1* 10/2017 Vanderbeck ..... G02B 26/10
2019/0112924 A1* 4/2019 Kawai ..... E21D 9/112
(Continued)

FOREIGN PATENT DOCUMENTS

CN 108386230 A 8/2018
CN 110454231 A 11/2019
CN 110542388 A 12/2019

*Primary Examiner* — Mohamed Barakat
(74) *Attorney, Agent, or Firm* — Mei & Mark LLP; Manni Li

(57) ABSTRACT

A safe early warning method and device for full-section tunneling of a tunnel featuring dynamic water and weak surrounding rock, comprising establishing a dynamic coordinate system with an origin thereof moving along a tunnel excavation line, recording the moving distance of the origin, conducting three-dimensional laser scanning with the origin as a center to obtain point cloud data including coordinate data, collecting surrounding rock data; conducting deformation fitting on the point cloud data, calculating a fitting residual error, removing a noisy point, and conducting preprocessing; combining data of preprocessed point cloud, surrounding rock, and the tunnel excavation line to construct a tunnel excavation dynamic model; conducting stress analysis according to the model and determining whether to send out a safety early warning signal. The device comprises a three-dimensional laser scanner, a geological radar device, a displacement module, an industrial computer, a data transmission module, an alarm, and a server.

9 Claims, 4 Drawing Sheets

(56) References Cited

U.S. PATENT DOCUMENTS

| | | | | |
|---|---|---|---|---|
| 2020/0011176 | A1* | 1/2020 | Huo | E21D 9/11 |
| 2020/0208518 | A1* | 7/2020 | Bentura | E21F 17/18 |
| 2021/0180452 | A1* | 6/2021 | Weiser | E21D 9/003 |

* cited by examiner

SAFETY EARLY WARNING METHOD AND DEVICE FOR FULL-SECTION TUNNELING OF TUNNEL FEATURING DYNAMIC WATER AND WEAK SURROUNDING ROCK

CROSS-REFERENCE TO RELATED APPLICATIONS

The subject application claims priority on Chinese patent application no. 202011088248.X filed on Oct. 13, 2020 in China. The contents and subject matters of the Chinese priority application is incorporated herein by reference.

BACKGROUND OF THE INVENTION

Technical Field

The invention relates to the technical fields of data processing and tunneling construction safety, in particular to a safety early warning method and device for full-section tunneling of a tunnel featuring dynamic water and weak surrounding rock.

Description of Related Art

China has been vigorously developing the construction of transportation infrastructure and is seeing rapid growth in railways, highways and subways every year. Tunneling is required in many transportation infrastructure lines. It is very important to know the geological conditions in tunneling construction. Otherwise, it may lead to safety accidents during tunnel construction or operation.

Among various geological investigation means, investigation methods and analysis methods, there are geological radar method, advanced horizontal drilling method and Tunnel Seismic Prediction for advance geological prediction during tunneling. These methods can be used for forecasting the geological conditions of a trenchless area in front of a tunnel face and evaluate the safety status of tunnel construction.

During tunnel construction, in order to ensure the rationality of tunnel construction and the safety of construction personnel, it is necessary to collect rock mass information in advance and learn the geological conditions of a tunnel construction site in real-time. In traditional rock mass analysis of an excavation face, geological surveyors manually draw a geological sketch of the excavation face at a construction site and record data. Instruments used mainly include a geological compass and a ruler, and technical personnel generally record what is observed with the naked eye. Geological logging information obtained in this way cannot fully reflect the real situation of a tunnel, and often varies from technician to technician. The results can hardly be used for construction guidance, so the information generally only serves as a record of the basic geological conditions of an exposed surrounding rock face during construction excavation. Under normal circumstances, the geological conditions of the surrounding rock face formed by tunnel excavation are preliminarily judged based on experience, and whether to take other necessary measures is decided according to the judgment results. If relevant personnel are inexperienced or a misjudgment is made, safety accidents or unnecessary cost investment may be caused. Although a structural plane can be identified, the efficiency is low, the working environment is bad and the life of surveyors is in danger.

Geological sketching can hardly meet the rapid development of tunnels any more. At present, the automatic identification of rock mass is mostly achieved by measuring the structural plane by photography, and the structural plane of the rock mass is mainly identified by taking photos. Compared with geological sketching, close-range photography can improve the efficiency and reduce the workload, and can also be used in dangerous situations. However, the number of points that can be obtained is limited, and the photography quality is easily affected by the harsh environment in the tunnel, so the numerical accuracy of coordinates cannot meet the requirement for high accuracy.

BRIEF SUMMARY OF THE INVENTION

In order to solve the above technical problems, the present invention provides a safety early warning method for full-section tunneling of a tunnel featuring dynamic water and weak surrounding rock, which comprises the following steps:

S100, establishing a dynamic coordinate system with an origin of the coordinate system moving along a tunnel excavation line as tunnel excavation construction progresses, recording the moving distance of the origin, conducting three-dimensional laser scanning in real-time with the origin as a center to obtain point cloud data which include coordinate data, and collecting surrounding rock data in real-time;

S200, preprocessing the point cloud data, then conducting deformation fitting, calculating a fitting residual error, and removing a noisy point by taking a set multiple of the fitting residual error deviating from its mean value as a noisy point criterion;

S300, combining the preprocessed point cloud data, surrounding rock data and the tunnel excavation line to construct a tunnel excavation dynamic model; and

S400, conducting stress analysis according to the tunnel excavation dynamic model, and determining whether to send out a safety early warning signal according to the results of stress analysis.

Optionally, in S100, the three-dimensional laser scanning is conducted with a three-dimensional laser scanner, the point cloud data obtained by scanning are coordinate data of discrete three-dimensional point sets, the surrounding rock data are collected by a geological radar device, and the surrounding rock data include the dynamic water shape and surrounding rock state of a tunnel face, and the surrounding rock state of a tunnel sidewall, a vault and a bottom face around the origin.

Optionally, in S200, the preprocessing is normalization processing, which is conducted as follows:

S210, constructing a triangular mesh model according to the coordinate data of the discrete three-dimensional point sets, determining the centroid of point sets in each triangle range in the triangular mesh model, and translating all points in the triangle range in the coordinate system to move the centroid to the origin of coordinates;

S220, scaling the coordinate system to a certain size, and selecting an appropriate isotropic scaling factor to scale point cloud coordinates in equal proportion, so that the average distance from all points to the origin is 1; and

S230, outputting three-dimensional point set data of the processed triangular mesh model.

Optionally, in S300, a computational geometry algorithm library is used to construct the tunnel excavation dynamic model as follows:

S310, fitting the three-dimensional point set data of the normalized triangular mesh model using the computational geometry algorithm library and surface reconstruction technology, transforming the triangular mesh model into a two-dimensional face model with a triangular mesh, and performing edge optimization on the triangular mesh of the two-dimensional face model to eliminate convex hulls;

S320, conducting distance and adjacency analysis on triangular patches in the two-dimensional face model, screening out the triangular patches which can be connected and connecting them into structural planes, conducting structural plane optimization, and combining the structural planes into dynamic three-dimensional graphics; and S330, combining the dynamic three-dimensional graphics in the dynamic moving direction of the coordinate origin to form the tunnel excavation dynamic model.

Optionally, the structural plane optimization comprises: removing disordered planes which do not belong to the tunnel structural planes and filling local cavities formed after the structural planes are connected.

Optionally, in S400, the stress analysis is conducted as follows:

calculating the stress components of a tunnel section in all directions by the following formula:

$$\sigma_x=2\ \mathrm{Re}[f(x+yi)]-\mathrm{Re}[(x-yi)f(x+yi)+w(x+yi)]$$

$$\sigma_y=2\ \mathrm{Re}[f(x+yi)]+\mathrm{Re}[(x-yi)f(x+yi)+w(x+yi)]$$

$$\sigma_{xy}=\mathrm{Im}[(x-yi)f(x+yi)+w(x+yi)]$$

where $\sigma_x$ indicates the stress component in the horizontal direction, $\sigma_y$ indicates the stress component in the vertical direction, $\sigma_{xy}$ indicates the stress component in the 45-degree inclination direction, Re indicates taking a real part of a complex function, Im indicates taking an imaginary part of the complex function, x indicates the horizontal width of the tunnel, y indicates the vertical height of the tunnel, i represents an imaginary number, and f(x+yi) and w(x+yi) represent a complex stress function:

$$f(x+yi)=\frac{1}{2\pi\left(1+\frac{3-\gamma}{1+\gamma}\right)}(F_x+iF_y)\ln(x+yi)$$

$$w(x+yi)=\frac{1}{2\pi\left(1+\frac{3-\gamma}{1+\gamma}\right)}(F_x+iF_y)\ln(x+yi)$$

where $F_x$ represents the surface force in the horizontal direction, $F_y$ indicates the surface force in the vertical direction, and $\gamma$ represents Poisson's ratio.

If any one of the calculated stress components of the tunnel section in all directions reaches or exceeds the stress threshold of surrounding rock, a safety early warning signal will be sent out.

Optionally, the method further comprises tunnel excavation dynamic model verification, which comprises: shooting surrounding rock images in the tunnel through monitoring, analyzing characteristic information from the monitored images by using a preset algorithm, and converting the characteristic information into verification characteristic quantities; extracting model feature data of a corresponding position of the monitoring images from the tunnel excavation dynamic model, then comparing the verification characteristic quantities with the model feature data to determine whether the difference between them is within the set range, conducting local secondary laser scanning on the corresponding position to obtain secondary scanning data if the difference exceeds the set range, and processing the secondary scanning data by S200 and S300 to adjust the tunnel excavation dynamic model.

Optionally, the method further comprises crack judgment, which comprises: recording crack existence and crack data of the surrounding rock of the tunnel by laser scanning, wherein the crack data comprise crack length, width, direction and density information; conducting analysis according to the crack data; determining a crack coefficient; correcting the stress calculation of the surrounding rock by using the crack coefficient; and evaluating whether the stress threshold of the surrounding rock is exceeded.

The invention also provides a safety early warning device for full-section tunneling of a tunnel featuring dynamic water and weak surrounding rock, which comprises a three-dimensional laser scanner, a geological radar device, a displacement module, an industrial computer, a data transmission module, an alarm and a server.

The three-dimensional laser scanner is used for conducting three-dimensional laser scanning on a tunnel in real-time with an origin as a center to obtain point cloud data;

the geological radar device is used for collecting surrounding rock data in real-time;

the displacement module is used for allowing the origin of a coordinate system to move along a tunnel excavation line as tunnel excavation construction progresses;

the industrial computer is connected with the three-dimensional laser scanner, the geological radar device, the displacement module, the data transmission module and the alarm, conducts data interaction with the server through the data transmission module, and controls the three-dimensional laser scanner, the geological radar device, the displacement module and the alarm according to instructions;

the data transmission module is used for data interaction between the industrial computer and the server;

the alarm is used for sending an alarm under the control of the industrial computer according to instructions; and the server is connected with the data transmission module and used for processing and analyzing the received data, generating relevant instructions according to analysis results and transmitting the instructions to the industrial computer.

Optionally, the device further comprises a display that is connected with the server, and the alarm comprises a buzzer and a flashing indicator lamp.

According to the invention, the data of full-section tunneling of the weak surrounding rock tunnel are acquired in real-time by tracking and three-dimensional laser scanning, so that the degree that the data acquisition is influenced by the tunnel environment is reduced; and the acquired data are preprocessed first so that abnormal data can be filtered out, then the tunnel excavation dynamic model is constructed in combination with the excavation line, the surrounding rock stress of tunnel excavation is analyzed on the basis of the model to evaluate whether safety risks exist, and corresponding warnings are given, so that measures can be taken in time to strengthen prevention. According to the invention, the data are comprehensive, the surrounding rock data are processed in real-time, the surrounding rock condition during tunneling can be fed back in time, the risk situation can be evaluated, and a warning is given when risks exist so that first-aid measures can be taken quickly and the smooth progress and safety of tunnel construction can be guaranteed.

Additional features and advantages of the invention will be set forth in the description which follows, and in part will be obvious from the description, or may be learned by practice of the invention. The objects and other advantages of the present invention can be realized and obtained by the structure, particularly pointed out in the written specification, claims, and drawings.

The technical solution of the present invention will be described in further detail with reference to the drawings and embodiments.

BRIEF DESCRIPTION OF THE SEVERAL VIEWS OF THE DRAWINGS

The accompanying drawings serve to provide a further understanding of the present invention and form a part of the specification, and together with the embodiments of the present invention, serve to explain the present invention, and do not constitute a limitation of the present invention. In the drawings.

DETAILED DESCRIPTION OF THE INVENTION

The preferred embodiments of the present invention will be described hereinafter with reference to the accompanying drawings. It should be understood that the preferred embodiments described here are only used to illustrate and explain the present invention and are not used to limit the present invention.

Figure 1:
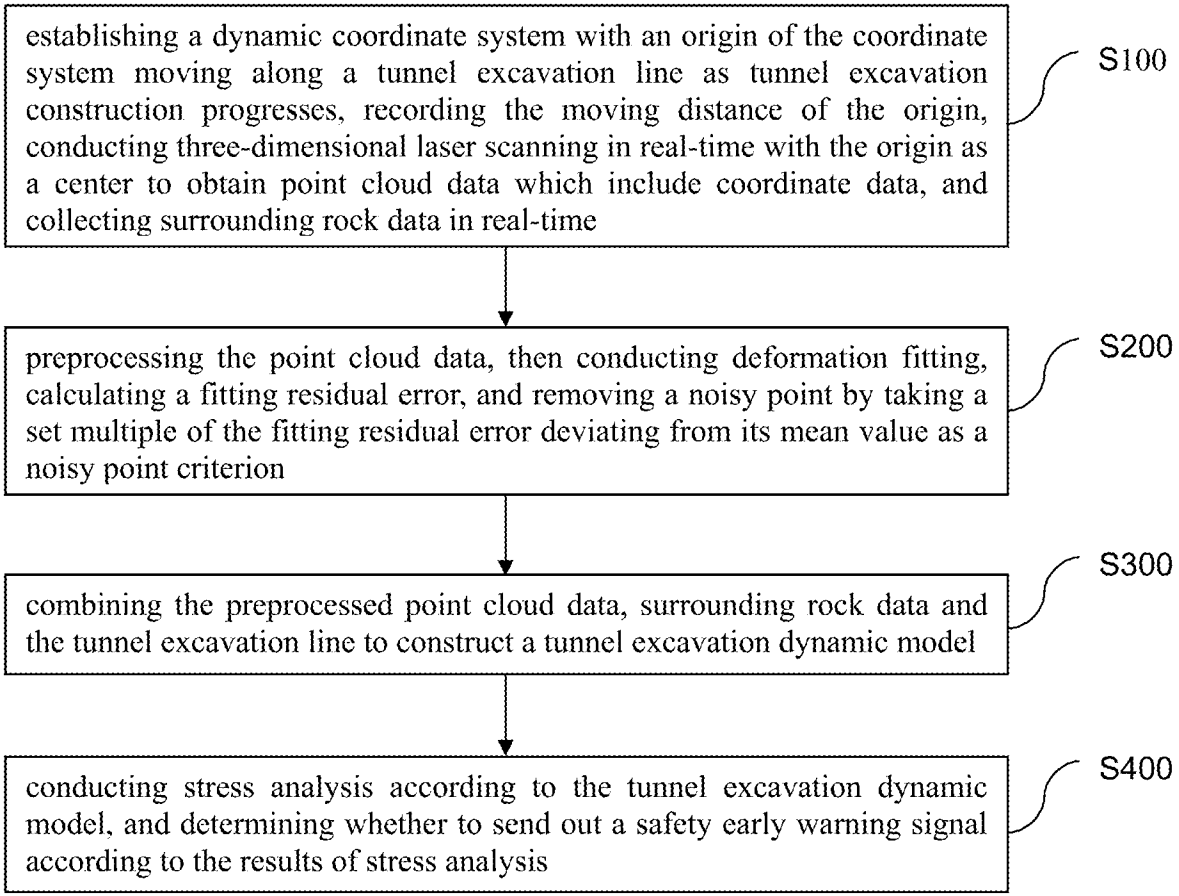
FIG. 1 is a flow chart of a safety early warning method for full-section tunneling of a tunnel featuring dynamic water and weak surrounding rock in an embodiment of the present invention.

As shown in FIG. 1, an embodiment of the invention provides a safe early warning method for full-section tunneling of a tunnel featuring dynamic water and weak surrounding rock, which comprises the following steps:

S100, establishing a dynamic coordinate system with an origin of the coordinate system moving along a tunnel excavation line as tunnel excavation construction progresses, recording the moving distance of the origin, conducting three-dimensional laser scanning in real-time with the origin as a center to obtain point cloud data which include coordinate data, and collecting surrounding rock data in real-time;

S200, preprocessing the point cloud data, then conducting deformation fitting, calculating a fitting residual error, and removing a noisy point by taking a set multiple of the fitting residual error deviating from its mean value as a noisy point criterion;

S300, combining the preprocessed point cloud data, surrounding rock data and the tunnel excavation line to construct a tunnel excavation dynamic model; and S400, conducting stress analysis according to the tunnel excavation dynamic model, and determining whether to send out a safety early warning signal according to the results of stress analysis.

The working principle of the above technical solution is as follows: the point cloud data of full-section tunneling of the weak surrounding rock tunnel are acquired in real-time by tracking and three-dimensional laser scanning, and the tunnel surrounding rock data are acquired too; the acquired point cloud data are preprocessed first so that abnormal data can be filtered out, and the set multiple of the fitting residual deviation from its mean value is used as the judgment standard for noisy point elimination, for example, the set multiple can be twice the mean value of the fitting residual value, which means the data points that reach more than twice are noisy points; and then the tunnel excavation dynamic model is constructed in combination with the excavation line, the tunnel excavation dynamic model contains tunnel coordinate data and surrounding rock data of the tunnel, so that the surrounding rock stress of tunnel excavation can be analyzed on the basis of the model to evaluate whether safety risks exist at the current coordinate position, and corresponding warnings are given, so that measures can be taken in time to strengthen prevention.

The technical solution has the beneficial effects that: by tracking and three-dimensional laser scanning, the degree that data acquisition is affected by the tunnel environment is reduced, and the surrounding rock point cloud data of the excavation sites can be collected comprehensively; in addition, the tunnel surrounding rock data can be collected in real-time, and the data processing can be carried out in real-time, so that the tunneling surrounding rock condition can be fed back in time, the risk situation can be evaluated, and a warning can be given when there are risks so that first-aid measures can be taken quickly and the smooth progress and safety of tunnel construction can be guaranteed.

In one embodiment, in S100, the three-dimensional laser scanning is conducted with a three-dimensional laser scanner, the point cloud data obtained by scanning are coordinate data of discrete three-dimensional point sets, the surrounding rock data are collected by a geological radar device, and the surrounding rock data include the dynamic water shape and surrounding rock state of a tunnel face, and the surrounding rock state of a tunnel sidewall, a vault and a bottom face around the origin.

The working principle and beneficial effects of the above technical solution are as follows: the solution adopts the three-dimensional laser scanner as an instrument for three-dimensional laser scanning, and makes full use of the advantage of the three-dimensional laser scanner in three-dimensional scanning, so as to quickly acquire the point cloud data of tunneling, determine the shapes and sizes of the tunnel sidewall, the vault and the bottom face, and collect the surrounding rock data by the geological radar device, so as to learn the dynamic water shape and surrounding rock state of the tunnel face, and the surrounding rock state of the tunnel sidewall, the vault and the bottom face around the origin, thus laying a foundation for subsequent model construction and data analysis.

Figure 2:
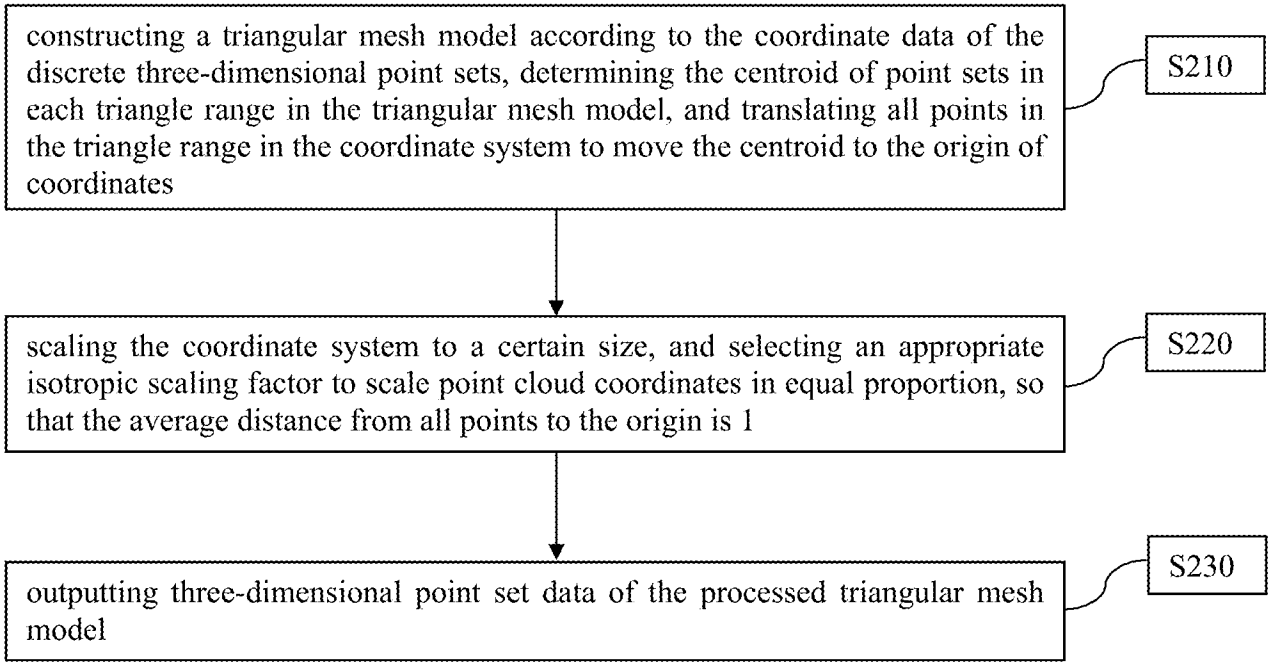
FIG. 2 is a flow chart of preprocessing adopted by an embodiment of a safety early warning method for full-section tunneling of a tunnel featuring dynamic water and weak surrounding rock in the present invention.

In one embodiment, as shown in FIG. 2, in S200, the preprocessing is normalization processing, which is conducted as follows:

S210, constructing a triangular mesh model according to the coordinate data of the discrete three-dimensional point sets, determining the centroid of point sets in each triangle range in the triangular mesh model, and translating all points in the triangle range in the coordinate system to move the centroid to the origin of coordinates;

S220, scaling the coordinate system to a certain size, and selecting an appropriate isotropic scaling factor to scale point cloud coordinates in equal proportion so that the average distance from all points to the origin is 1; and

S230, outputting three-dimensional point set data of the processed triangular mesh model.

The working principle of the above technical solution is as follows: based on the triangle segmentation theory, the triangular mesh model is established for the coordinate data of the tunnel three-dimensional point sets, the centroid coordinates of each triangle are determined, the centroid coordinates coincide with the coordinate origin of the current coordinates by simulating translation, and then the isotropic scaling factor is selected for scaling.

The above technical solution has the beneficial effects that normalization processing can greatly improve the accuracy of calculation results, data are limited to a required range after being processed with a certain algorithm, and normalization allows the accuracy of results of subsequent calculation and processing of data to be higher, and realizes invariance of any degree of scaling and the coordinate origin.

Figure 3:
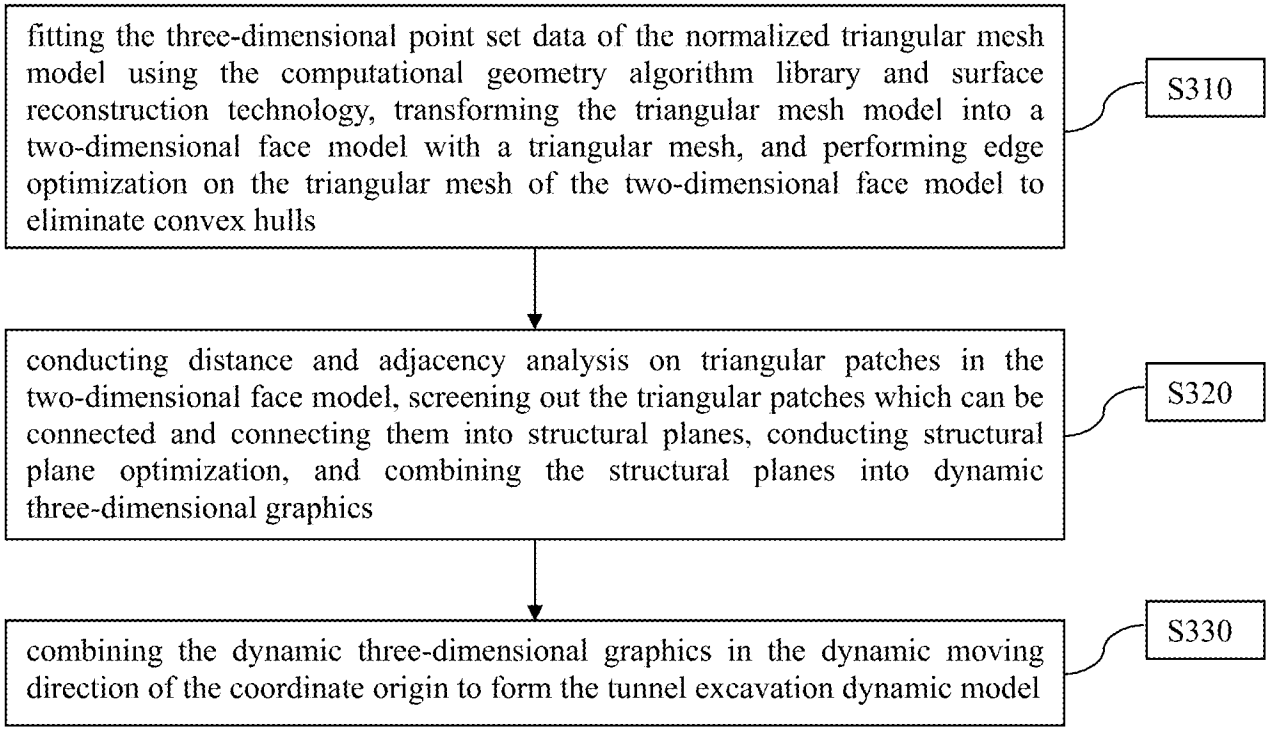
FIG. 3 is a flow chart of a tunnel excavation dynamic model construction method adopted by an embodiment of a safety early warning method for full-section tunneling of a tunnel featuring dynamic water and weak surrounding rock in the present invention.

In one embodiment, as shown in FIG. 3, in S300, a computational geometry algorithm library is used to construct the tunnel excavation dynamic model as follows:

S310, fitting the three-dimensional point set data of the normalized triangular mesh model using the computational geometry algorithm library and surface reconstruction technology, transforming the triangular mesh model into a two-dimensional face model with a triangular mesh, and performing edge optimization on the triangular mesh of the two-dimensional face model to eliminate convex hulls;

S320, conducting distance and adjacency analysis on triangular patches in the two-dimensional face model, screening out the triangular patches which can be connected and connecting them into structural planes, conducting structural plane optimization, and combining the structural planes into dynamic three-dimensional graphics; and

S330, combining the dynamic three-dimensional graphics in the dynamic moving direction of the coordinate origin to form the tunnel excavation dynamic model.

The working principle of the above technical solution is as follows: this solution may use the computational geometry algorithm library (CGAL), which provides main data structures and algorithms in computational geometry in the form of C++ library, mainly including triangulation, Voronoi diagram, polygon, geometric processing and convex hull algorithm, interpolation, shape analysis, fitting and distance, etc. CGAL can provide accurate, robust, flexible and easy-to-use computational geometry solutions. Based on the triangular mesh model, this solution identifies the structural plane by scanning the distance from a center point to the triangular patch, fits the triangular patches which are close and connected, combines points into planes, and then combines planes into three-dimensional shapes to form the three-dimensional tunnel excavation dynamic model.

The technical solution has the beneficial effects that: based on the coordinate data obtained by scanning, the structural planes are formed by connection through distance and adjacency analysis, optimized, recombined into the dynamic three-dimensional graphics, and then superposed and combined in the dynamic moving direction of the coordinate origin to form the tunnel excavation dynamic model; and with this solution, there is no need for manual operation during rock mass structural plane identification and modeling, and the degree of automation is high.

In one embodiment, the structural plane optimization comprises: removing disordered planes which do not belong to the tunnel structural planes and filling local cavities formed after the structural planes are connected.

The working principle and beneficial effects of the above technical solution are as follows: based on the fact that an approximate plane of the structural plane has a certain scale, the structural planes with small scales are eliminated; and through structural plane optimization, the solution makes up for the possible errors or omissions in scanning and collecting data, and makes the tunnel excavation dynamic model more complete.

In one embodiment, in S400, the stress analysis is conducted as follows:

calculating the stress components of a tunnel section in all directions by the following formula:

$$\sigma_x=2\ \mathrm{Re}[f(x+yi)]-\mathrm{Re}[(x-yi)f(x+yi)+w(x+yi)]$$

$$\sigma_y=2\ \mathrm{Re}[f(x+yi)]+\mathrm{Re}[(x-yi)f(x+yi)+w(x+yi)]$$

$$\sigma_{xy}=\mathrm{Im}[(x-yi)f(x+yi)+w(x+yi)]$$

where $\sigma_x$ indicates the stress component in the horizontal direction, $\sigma_y$ indicates the stress component in the vertical direction, $\sigma_{xy}$ indicates the stress component in the 45-degree inclination direction, Re indicates taking a real part of a complex function, Im indicates taking an imaginary part of the complex function, x indicates the horizontal width of the tunnel, y indicates the vertical height of the tunnel, i represents an imaginary number, and f(x+yi) and w(x+yi) represent a complex stress function:

$$f(x+yi)=\frac{1}{2\pi\left(1+\frac{3-\gamma}{1+\gamma}\right)}(F_x+iF_y)\ln(x+yi)$$

$$w(x+yi)=\frac{1}{2\pi\left(1+\frac{3-\gamma}{1+\gamma}\right)}(F_x+iF_y)\ln(x+yi)$$

where $F_x$ represents the surface force in the horizontal direction, $F_y$ indicates the surface force in the vertical direction, and $\gamma$ represents Poisson's ratio.

If any one of the calculated stress components of the tunnel section in all directions reaches or exceeds the stress threshold of surrounding rock, a safety early warning signal will be sent out.

The working principle and beneficial effects of the above technical solution are as follows: based on the complex function, this solution solves the stress components of the surrounding rock in the full section of the tunnel according to an equilibrium equation and compatibility equation of an elastic theory, and the stress situation at any point around a tunnel chamber is further solved; finally, an analytical calculation model is analyzed by finite element modeling to verify the accuracy of the analysis; the verified analytical algorithm can provide theoretical reference for the design and construction of similar working conditions, and has great engineering significance; and through the above formula, the stress of the surrounding rock of the tunnel can be comprehensively analyzed, and the possible safety risks can be judged on this basis with high accuracy.

In one embodiment, the method further comprises tunnel excavation dynamic model verification, which comprises:

shooting surrounding rock images in the tunnel through monitoring, analyzing characteristic information from the monitored images by using a preset algorithm, and converting the characteristic information into verification characteristic quantities; extracting model feature data of a corresponding position of the monitoring images from the tunnel excavation dynamic model, then comparing the verification characteristic quantities with the model feature data to determine whether the difference between them is within the set range, conducting local secondary laser scanning on the corresponding position to obtain secondary scanning data if the difference exceeds the set range, and processing the secondary scanning data by S200 and S300 to adjust the tunnel excavation dynamic model.

The working principle and beneficial effects of the above technical solution are as follows: this solution judges the fit degree between the model and actual tunnel excavation through model verification, and if the difference between the two is beyond the set range, it means that there is local distortion in the model, so adjustment and remedy are carried out to ensure that the tunnel excavation dynamic model is consistent with the actual tunnel excavation, avoid affecting subsequent data analysis and results, and ensure the smooth progress of the project.

In one embodiment, the method further comprises crack judgment, which comprises: recording crack existence and crack data of the surrounding rock of the tunnel by laser scanning, wherein the crack data comprise crack length, width, direction and density information; conducting analysis according to the crack data; determining a crack coefficient; correcting the stress calculation of the surrounding rock by using the crack coefficient; and evaluating whether the stress threshold of the surrounding rock is exceeded.

The working principle and beneficial effects of the above-mentioned technical solution are as follows: in this solution, cracks on the surrounding rock of the tunnel are analyzed individually, and the crack coefficient is determined according to the influence of the cracks on stress for correcting stress analysis, so that stress analysis results include crack factors affecting safety, which further improves the accuracy of stress analysis, increases the accuracy of safety risk judgment and improves the effect of safety prediction during tunnel construction.

Figure 4:
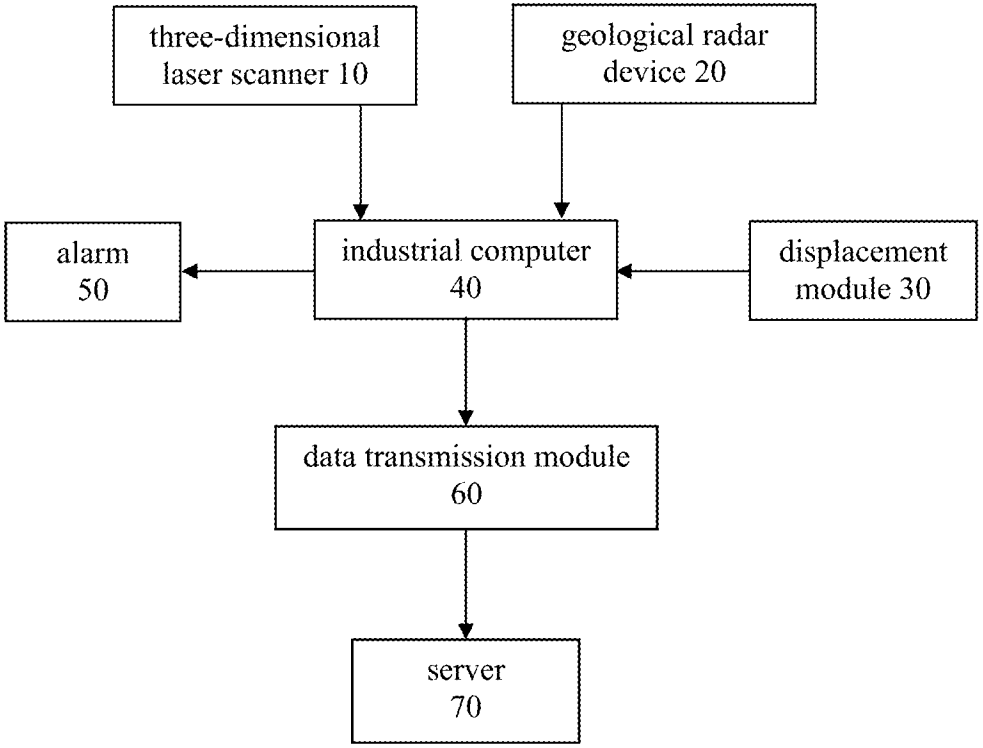
FIG. 4 is a structural diagram of an embodiment of a safety early warning device for full-section tunneling of a tunnel featuring dynamic water and weak surrounding rock in the present invention.

As shown in FIG. 4, an embodiment of the invention provides a safe early warning device for full-section tunneling of a tunnel featuring dynamic water and weak surrounding rock, which comprises a three-dimensional laser scanner 10, a geological radar device 20, a displacement module 30, an industrial computer 40, a data transmission module 60, an alarm 50 and a server 70.

The three-dimensional laser scanner 10 is used for conducting three-dimensional laser scanning on a tunnel in real-time with an origin as a center to obtain point cloud data;

the geological radar device 20 is used for collecting surrounding rock data in real-time;

the displacement module 30 is used for allowing the origin of a coordinate system to move along a tunnel excavation line as tunnel excavation construction progresses;

the industrial computer 40 is connected with the three-dimensional laser scanner 10, the geological radar device 20, the displacement module 30, the data transmission module 60 and the alarm 50, conducts data interaction with the server 70 through the data transmission module 60, and controls the three-dimensional laser scanner 10, the geological radar device 20, the displacement module 30 and the alarm 50 according to instructions;

the data transmission module is used for data interaction between the industrial computer and the server;

the alarm 50 is used for sending an alarm under the control of the industrial computer 40 according to instructions; and the server 70 is connected with the data transmission module 60 and used for processing and analyzing the received data, generating relevant instructions according to analysis results and transmitting the instructions to the industrial computer 40.

The working principle of the above technical solution is as follows: the point cloud data of full-section tunneling of the weak surrounding rock tunnel are acquired in real-time by tracking and three-dimensional laser scanning, the excavation line is followed by the displacement module, the surrounding rock data are collected in real-time by the geological radar device, which include the dynamic water shape and surrounding rock state of the tunnel face, and the surrounding rock state of the tunnel sidewall, the vault and the bottom face around the origin, data summarization is conducted by the industrial computer, data transmission is conducted by the data transmission module, the collected point cloud data are analyzed and processed by the server, so as to filter out abnormal data, and then the point cloud data and the surrounding rock data are combined with the excavation line to construct the tunnel excavation dynamic model; the tunnel excavation dynamic model contains tunnel coordinate data and various surrounding rock data of the tunnel; based on the model, the server analyzes the surrounding rock stress of tunnel excavation, and evaluates whether there is a safety risk at the current coordinate position; and if it is determined that there is a great safety risk, the industrial computer controls the alarm to give a warning, so as to take timely measures to strengthen prevention.

The technical solution has the beneficial effects that: by tracking and three-dimensional laser scanning, the degree that data acquisition is affected by the tunnel environment is reduced, and the surrounding rock point cloud data of the excavation sites can be collected comprehensively; in addition, the tunnel surrounding rock data can be collected in real-time by the geological radar device, and the data processing can be carried out in real-time, so that the tunneling surrounding rock condition can be fed back in time, the risk situation can be evaluated, and a warning can be given when there are risks so that first-aid measures can be taken quickly and the smooth progress and safety of tunnel construction can be guaranteed.

In one embodiment, the device further comprises a display that is connected with the server 70, and the alarm 50 comprises a buzzer and a flashing indicator lamp.

The working principle and beneficial effects of the above technical solution are as follows: by arranging the display, the collected data and the data processing and analysis processes can be visualized so that operators can visually learn the surrounding rock conditions of tunnel excavation; and the alarm comprises both the buzzer and the flashing indicator lamp so that when a safety risk is discovered, the buzzer gives out an audio alarm, and the flashing indicator lamp gives out a light alarm, and the combination of the two can enhance the warning effect.

In the present invention, a safe early warning method and device for full-section tunneling of a tunnel featuring dynamic water and weak surrounding rock are provided. The method comprises: S100, establishing a dynamic coordinate system with an origin of the coordinate system moving along a tunnel excavation line as tunnel excavation construction progresses, recording the moving distance of the origin, conducting three-dimensional laser scanning in real-time with the origin as a center to obtain point cloud data which include coordinate data, and collecting surrounding rock data in real-time; S200, conducting deformation fitting on the point cloud data, calculating a fitting residual error, removing a noisy point by taking a set multiple of the fitting residual error deviating from its mean value as a noisy point criterion, and then conducting preprocessing; S300, combining the preprocessed point cloud data, surrounding rock data and the tunnel excavation line to construct a tunnel excavation dynamic model; and S400, conducting stress analysis according to the tunnel excavation dynamic model, and determining whether to send out a safety early warning signal according to the results of stress analysis. The device comprises a three-dimensional laser scanner, a geological radar device, a displacement module, an industrial computer, a data transmission module, an alarm, and a server.

Obviously, those skilled in art can make various changes and modifications to the invention without departing from the spirit and scope of the invention. Thus, if these modifications and variations of the invention fall within the scope of the claims of the invention and their equivalents, the invention is also intended to include these modifications and variations.

What is claimed is:

1. A safety early warning method for full-section tunneling of a tunnel featuring dynamic water and weak surrounding rock, comprising:

S100, establishing a dynamic coordinate system, moving an origin of the dynamic coordinate system along a tunnel excavation line as tunnel excavation construction progresses, recording a distance of movement of the origin, conducting a three-dimensional laser scanning in real-time with the origin as a center to obtain point cloud data which include coordinate data, and collecting surrounding rock data in real-time;

S200, preprocessing the point cloud data, then conducting deformation fitting, calculating a fitting residual error, and removing a noisy point by taking a set multiple of the fitting residual error deviating from its mean value as a noisy point criterion;

S300, combining the preprocessed point cloud data, surrounding rock data, and the tunnel excavation line to construct a tunnel excavation dynamic model; and

S400, conducting stress analysis according to the tunnel excavation dynamic model, and determining whether to send out a safety early warning signal according to results of the stress analysis, wherein the stress analysis is conducted as follows:

calculating stress components of a tunnel section in all directions by the following formula:

$$\sigma_x=2\,\mathrm{Re}[f(x+yi)]-\mathrm{Re}[(x-yi)f(x+yi)+w(x+yi)]$$

$$\sigma_y=2\,\mathrm{Re}[f(x+yi)]+\mathrm{Re}[(x-yi)f(x+yi)+w(x+yi)]$$

$$\sigma_{xy}=\mathrm{Im}[(x-yi)f(x+yi)+w(x+yi)]$$

wherein $\sigma_x$ indicates a stress component in a horizontal direction, $\sigma_y$ indicates a stress component in a vertical direction, $\sigma_{xy}$ indicates a stress component in a 45-degree inclination direction, Re indicates taking a real part of a complex function, Im indicates taking an imaginary part of the complex function, x indicates the horizontal width of the tunnel, y indicates the vertical height of the tunnel, i represents an imaginary number, and f(x+yi) and w(x+yi) represent a complex stress function:

$$f(x+yi)=\frac{1}{2\pi\left(1+\frac{3-\gamma}{1+\gamma}\right)}(F_x+iF_y)\ln(x+yi)$$

$$w(x+yi)=\frac{1}{2\pi\left(1+\frac{3-\gamma}{1+\gamma}\right)}(F_x+iF_y)\ln(x+yi),$$

wherein $F_x$ represents a surface force in the horizontal direction, $F_y$ indicates a surface force in the vertical direction, and $\gamma$ represents Poisson's ratio, and sending out a safety early warning when any of the calculated stress components of the tunnel section in all directions reaches or exceeds a stress threshold of surrounding rock.

2. The safety early warning method for full-section tunneling of the tunnel featuring dynamic water and weak surrounding rock according to claim 1, wherein in S100, the three-dimensional laser scanning is conducted with a three-dimensional laser scanner, the point cloud data obtained by scanning are coordinate data of discrete three-dimensional point sets, the surrounding rock data are collected by a geological radar device, and the surrounding rock data include the dynamic water shape and surrounding rock state of a tunnel face, and the surrounding rock state of a tunnel sidewall, a vault and a bottom face around the origin.

3. The safety early warning method for full-section tunneling of the tunnel featuring dynamic water and weak surrounding rock according to claim 2, wherein in S200, the preprocessing is normalization processing that is conducted as follows:

S210, constructing a triangular mesh model according to the coordinate data of the discrete three-dimensional point sets, determining the centroid of point sets in each triangle range in the triangular mesh model, and translating all points in the triangle range in the coordinate system to move the centroid to the origin of coordinates;

S220, scaling the coordinate system to a certain size, and selecting an appropriate isotropic scaling factor to scale point cloud coordinates in equal proportion so that the average distance from all points to the origin is 1; and

S230, outputting three-dimensional point set data of the processed triangular mesh model.

4. The safety early warning method for full-section tunneling of the tunnel featuring dynamic water and weak surrounding rock according to claim 3, wherein in S300, a computational geometry algorithm library is used to construct the tunnel excavation dynamic model as follows:

S310, fitting the three-dimensional point set data of the normalized triangular mesh model using the computational geometry algorithm library and surface reconstruction technology, transforming the triangular mesh model into a two-dimensional face model with a triangular mesh, and performing edge optimization on the triangular mesh of the two-dimensional face model to eliminate convex hulls;

S320, conducting distance and adjacency analysis on triangular patches in the two-dimensional face model, screening out the triangular patches which can be connected and connecting them into structural planes, conducting structural plane optimization, and combining the structural planes into dynamic three-dimensional graphics; and

S330, combining the dynamic three-dimensional graphics in the dynamic moving direction of the coordinate origin to form the tunnel excavation dynamic model.

5. The safety early warning method for full-section tunneling of the tunnel featuring dynamic water and weak surrounding rock, according to claim 4, wherein the structural plane optimization comprises removing disordered planes that do not belong to the tunnel structural planes and filling local cavities formed after the structural planes are connected.

6. The safety early warning method for full-section tunneling of the tunnel featuring dynamic water and weak surrounding rock according to claim 1, further comprising verifying tunnel excavation dynamic model by shooting surrounding rock images in the tunnel through monitoring, analyzing characteristic information from the monitored images by using a preset algorithm, and converting the characteristic information into verification characteristic quantities; and extracting model feature data of a corresponding position of the monitoring images from the tunnel excavation dynamic model, then comparing the verification characteristic quantities with the model feature data to determine whether the difference between them is within the set range, conducting local secondary laser scanning on the corresponding position to obtain secondary scanning data if the difference exceeds the set range, and processing the secondary scanning data by S200 and S300 to adjust the tunnel excavation dynamic model.

7. The safety early warning method for full-section tunneling of the tunnel featuring dynamic water and weak surrounding rock according to claim 1, further comprising judging crack by recording crack existence and crack data of the surrounding rock of the tunnel by laser scanning, wherein the crack data comprise crack length, width, direction and density information; conducting analysis according to the crack data; determining a crack coefficient; correcting the stress calculation of the surrounding rock by using the crack coefficient; and evaluating whether the stress threshold of the surrounding rock is exceeded.

8. A safety early warning device for full-section tunneling of a tunnel featuring dynamic water and weak surrounding rock, comprising a three-dimensional laser scanner, a geological radar device, a displacement module, an industrial computer, a data transmission module, an alarm, and a server, wherein the three-dimensional laser scanner is used for conducting three-dimensional laser scanning on a tunnel in real-time with an origin as a center to obtain point cloud data;

the geological radar device is used for collecting surrounding rock data in real-time;

the displacement module is used for allowing the origin of a coordinate system to move along a tunnel excavation line as tunnel excavation construction progresses;

the industrial computer is connected with the three-dimensional laser scanner, the geological radar device, the displacement module, the data transmission module and the alarm, conducts data interaction with the server through the data transmission module, and controls the three-dimensional laser scanner, the geological radar device, the displacement module and the alarm according to instructions;

the data transmission module is used for data interaction between the industrial computer and the server;

the alarm is used for sending an alarm under the control of the industrial computer according to instructions;

the server is connected with the data transmission module and used for processing and analyzing the received data, generating relevant instructions according to analysis results and transmitting the instructions to the industrial computer;

the processing and analysis of the received data comprise:

constructing a tunnel excavation dynamic model, and conducting stress analysis according to the tunnel excavation dynamic model, and the stress analysis process is as follows:

calculating stress components of a tunnel section in all directions by the following formula:

$$\sigma_x=2\ \mathrm{Re}[f(x+yi)]-\mathrm{Re}[(x-yi)f(x+yi)+w(x+yi)]$$

$$\sigma_y=2\ \mathrm{Re}[f(x+yi)]+\mathrm{Re}[(x-yi)f(x+yi)+w(x+yi)]$$

$$\sigma_{xy}=\mathrm{Im}[(x-yi)f(x+yi)+w(x+yi)]$$

where $\sigma_x$ indicates a stress component in a horizontal direction, $\sigma_y$ indicates a stress component in a vertical direction, $\sigma_{xy}$ indicates a stress component in a 45-degree inclination direction, Re indicates taking a real part of a complex function, Im indicates taking an imaginary part of the complex function, x indicates the horizontal width of the tunnel, y indicates the vertical height of the tunnel, i represents an imaginary number, and f(x+yi) and w(x+yi) represent a complex stress function:

$$f(x+yi)=\frac{1}{2\pi\left(1+\frac{3-\gamma}{1+\gamma}\right)}(F_x+iF_y)\ln(x+yi)$$

$$w(x+yi)=\frac{1}{2\pi\left(1+\frac{3-\gamma}{1+\gamma}\right)}(F_x+iF_y)\ln(x+yi)$$

where $F_x$ represents a surface force in the horizontal direction, $F_y$ indicates a surface force in the vertical direction, and $\gamma$ represents Poisson's ratio, and sending out a safety early warning signal when any one of the calculated stress components of the tunnel section in all directions reaches or exceeds a stress threshold of the surrounding rock.

9. The safety early warning device for full-section tunneling of the tunnel featuring dynamic water and weak surrounding rock according to claim 8, further comprising a display that is connected with the server, and the alarm comprising a buzzer and a flashing indicator lamp.

* * * * *